US007052284B2

(12) United States Patent
Liao et al.

(10) Patent No.: US 7,052,284 B2
(45) Date of Patent: May 30, 2006

(54) ELECTRICAL CONTACT HAVING SHORTING MEMBER WITH REDUCED SELF-INDUCTANCE

(75) Inventors: Fang-Jun Liao, Tu-Chen (TW); Ming-Lun Szu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/027,531

(22) Filed: Dec. 29, 2004

(65) Prior Publication Data

US 2005/0233606 A1 Oct. 20, 2005

(30) Foreign Application Priority Data

Apr. 16, 2004 (TW) ..... 93110610 A

(51) Int. Cl.
*H01R 12/00* (2006.01)

(52) U.S. Cl. ..... 439/66; 439/862

(58) Field of Classification Search ..... 439/66, 439/862, 733.1

See application file for complete search history.

(56) References Cited

U.S. PATENT DOCUMENTS 5,653,598 A * 8/1997 Grabbe ..... 439/66
6,217,342 B1 * 4/2001 Neidich et al. ..... 439/66

* cited by examiner

*Primary Examiner*—Tho D. Ta
*Assistant Examiner*—Vanessa Girardi
(74) *Attorney, Agent, or Firm*—Wei Te Chung

(57) ABSTRACT

An electrical contact (1) includes a retention portion (10), a pair of spring arms (12,13) extending from two opposite sides of the retention portion, a pair of contact portions (14,15) formed at respective free ends of the spring arms and first and second cantilevers (16,17) extending from the free ends of the spring arms generally toward each other. The first and second cantilevers are spaced apart at some dimension when the contact is in an uncompressed state. First and second mating sections (160,170) formed at respective free ends of the first and second cantilevers, each having a sectional width larger than that of each of the free ends of the cantilevers, when the contact is compressed, the cantilevers close toward each other, the mating sections thereof engaging each other. Thus a shortened electrical path is established between the contact portions.

13 Claims, 5 Drawing Sheets

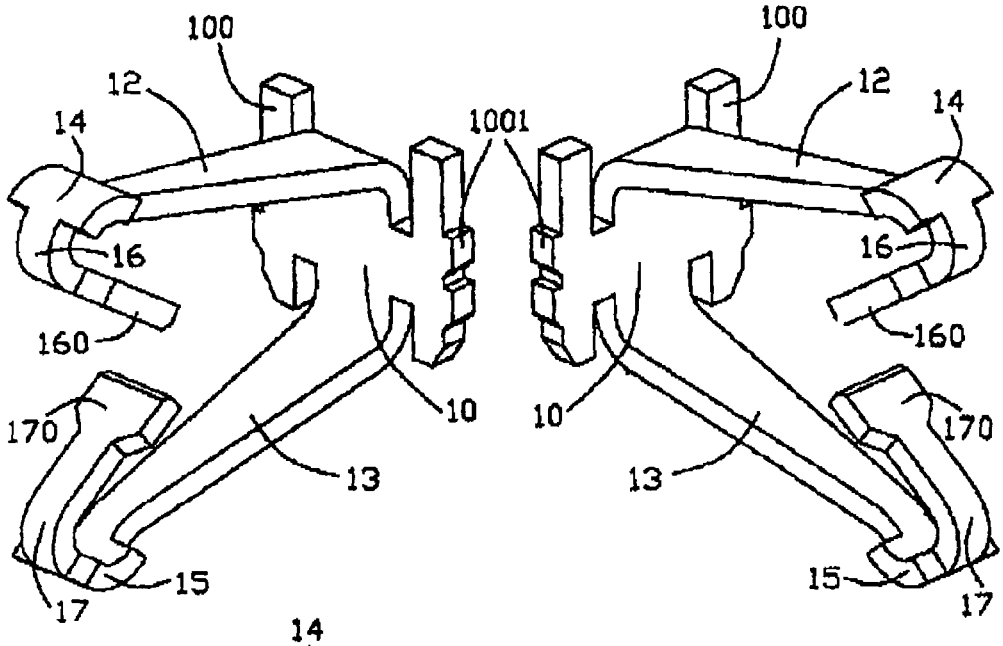
FIG. 1
FIG. 2
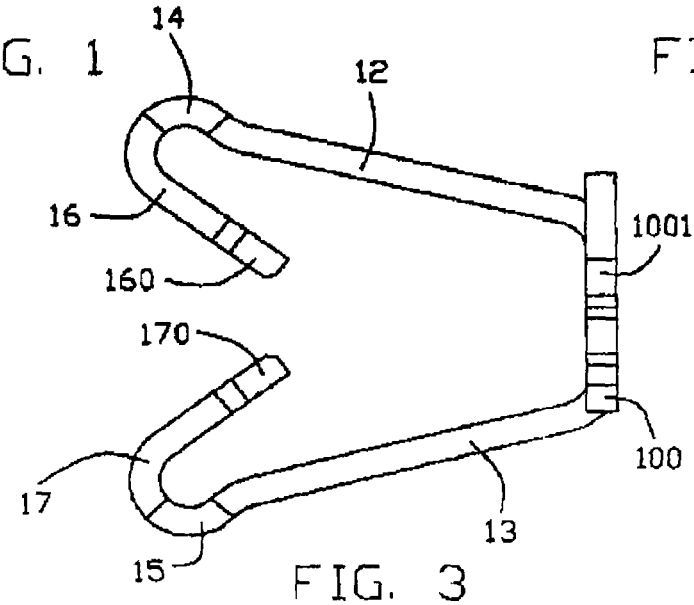
FIG. 3

ELECTRICAL CONTACT HAVING SHORTING MEMBER WITH REDUCED SELF-INDUCTANCE

BACKGROUND OF THE INVENTION

1. Field of the Invention

The present invention relates to an electrical contact, and more particularly to an electrical contact for electrically two electrical interfaces such as contact pads of an electrical package and a printed circuit board(PCB).

2. Description of the Prior Art

Electrical connectors are widely used in electronic equipment for electrically electrical packages with PCBs. Generally, a typical connector comprises a substantially flat dielectric housing resides between an electrical package and a PCB. The housing has an array of passageways with a plurality of electrical contacts therein. Each of the contacts has a pair of opposite relative long spring arms and a pair of contact portions formed at respective free ends of the spring arms. When the package is mounted to the connector, one of the contact portions is depressed and engages a respective lead of the package, and the other contact portion engages a respective pad on the board. Thus, a relatively long path is formed between the contact portions, extending through both the spring arms. The long path has high self-inductance effect and resistance, and this can affect electrical characteristic of the contact. Further, the spring arms may have weak elasticity after having been compressed repeatedly many times, and this thereby affecting firm electrical connecting between the package and the PCB. As a result, reliable and effective electrical connecting between the package and the PCB is reduced.

With development of electronic technology, electrical connector may transmit signal at very high frequencies, and this can give rise to significant self-inductance effects which may interfere a reliable signal transmission of the connector. Self-inductance effects can be reduced by reducing length of circuit path through the contact of the connector. However, it is desirable for the contact to have a relatively long spring arm to provide enough compliance necessary to permit resilient deformation without plastic deformation.

In view of the above, a new electrical contact which resolves the above-mentioned disadvantages is desired.

SUMMARY OF THE INVENTION

According, a main object of the present invention is to provide an electrical contact having reduced self-inductance effect.

To achieve the above-mentioned object, an electrical contact for used in a connector between mutually opposed electrical interfaces is provided. The contact comprises a retention portion, a pair of spring arms extending from two opposite sides of the retention portion, a pair of opposite contact portions formed at respective free ends of the spring arms and first and second resilient cantilevers extending from the free ends of the spring arms, generally toward each other. The first and second cantilevers are spaced apart at some dimension when the contact is in an uncompressed state. Respective first and second mating sections form at each of free ends of the cantilevers. A sectional width of the mating sections each is larger than a corresponding sectional width of the free ends of the cantilevers. When the contact is compressed, the cantilevers close toward together, and the mating sections thereof engage each other. Thus, a shortened and direct electrical path is established between the contact portions, thereby proving reduced self-inductance effect in the contact.

Other objects, advantages and novel features of the present invention will become more apparent from the following detailed description when taken in conjunction with the accompanying drawings, in which:

BRIEF DESCRIPTION OF THE DRAWINGS

FIG. 1 is an isometric view of a contact in accordance with a preferred embodiment of the present.

FIG. 2 is similar to FIG. 1, but viewed from an opposite aspect.

FIG. 3 is a side view of the contact of FIG. 1.

DETAILED DESCRIPTION OF THE PREFERRED EMBODIMENT OF THE INVENTION

Figure 4:
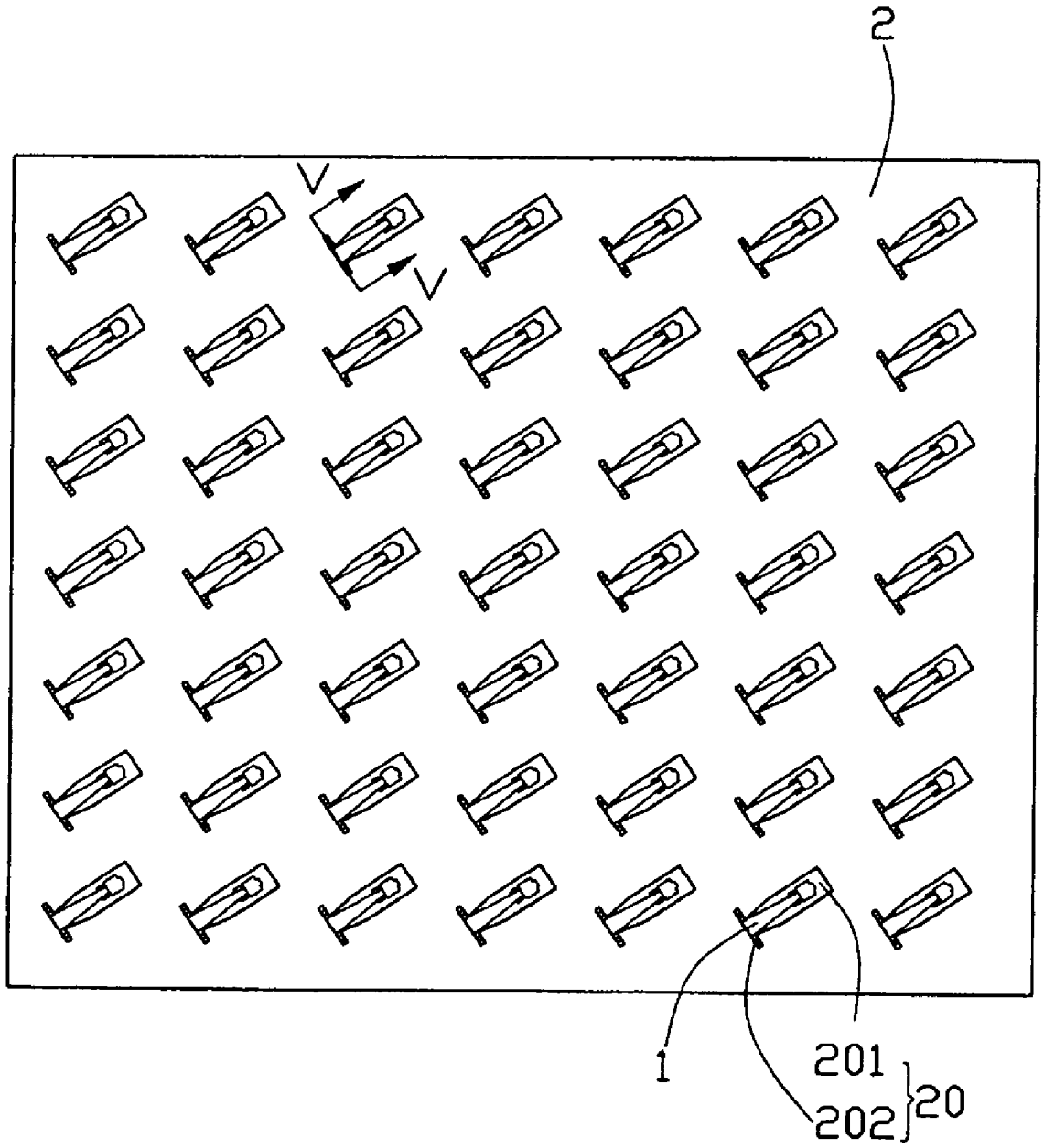
FIG. 4 is a top elevation view of a portion of a housing of an electrical connector, showing a plurality of contacts of FIG. 1 received in passageways of the housing.

Reference will now be made to the drawings to describe the present invention in detail.

Referring to FIGS. 1 to 3, an electrical contact 1 of the present invention is provided for electrical connecting two interfaces. The contact is preferably stamped from a sheet of conductive metallic material, and has a substantially symmetric C-shaped profile. The contact 1 comprises a vertical retention portion 10. first and second spring arms 12, 13 obliquely extending from two opposite sides of the retention portion 10, upper first and lower second convex contact portions 14, 15 respectively formed at free ends of the spring arms 12, 13, and respective first and second resilient shorting members 16, 17, each preferably in a form of cantilever (hereinafter referred to "first and second resilient cantilevers 16, 17"), extending from the free ends of the spring arms 12, 13.

The retention portion 10 has a planar configuration. An upper section and a lower section of the retention portion 10 are bifurcated respectively by the first and second spring arms 12,13. A pair of vertical opposite locating sections 100 thereby formed coplanarly on the retention portion 10. Two barbs 1001 protrude outwardly from a lower lateral side edge of each of the locating sections 100.

The first and second spring arms 12,13 are separated from each other and each have a generally curved and tapered configuration. Preferably, the spring arms 12,13 angularly diverge as they extend away from the retention portion 10, although the arms 12,13 may be parallel to each other. The first spring arm 12 extending slantingly and upwardly from a top horizontal side of the retention portion 10. The second spring arm 12 extending slantingly and downwardly from a bottom horizontal side of the retention portion 10.

The first contact portion 14 is located at a topmost free end of the first spring arm 12, for electrically engaging a respective one of the interfaces. The second contact 15 is situated at a bottommost free end of the second spring arm 13, for electrically engaging with the other of the interfaces.

Sectional widths of the first and contact portions 14,15 are larger than respective sectional widths of the free ends of the first and second spring arm 12, 13. This enable the first and second contact portions have relatively large contacting area with the interfaces. thereby giving the contact 1 good electrical connecting characteristic. Thus, a reliable electrical connecting of the contact and the two interfaces is secured.

The first and second cantilevers 16, 17 bend and extend inwardly and obliquely from the respective free ends of the first and second spring arms 12, 13. The cantilevers 16, 17 are generally opposite toward each other and are spaced apart at some dimension when the contact 1 is in an uncompressed condition. First and second mating sections 160, 170 are formed at respective free ends of the first arid second cantilevers 16, 17. Sectional dimensions of the mating sections 160, 170 are wider than those of the free ends of the first and second cantilevers 16, 17, respectively. When the contact 1 is in a compressed state, the cantilevers 16, 17 are relatively closer together, and the mating sections 160, 170 can engage each other.

The contact 1 is used in an electrical connector for electrically connecting a first electrical interface, such as leads of an electrical package to a second electrical interface, such us circuit paths on a printed circuit board. FIG. 4 shows portion of a dielectric housing 2 of such a connector in which a plurality of the contacts 1 is received. The housing 2 defines a plurality of passageways 20, for receiving the contacts 1 therein. The passageways 20 are arranged in a rectangular array of rows and columns corresponding to the array of leads of the electronic package mounted on the connector.

Figure 5:
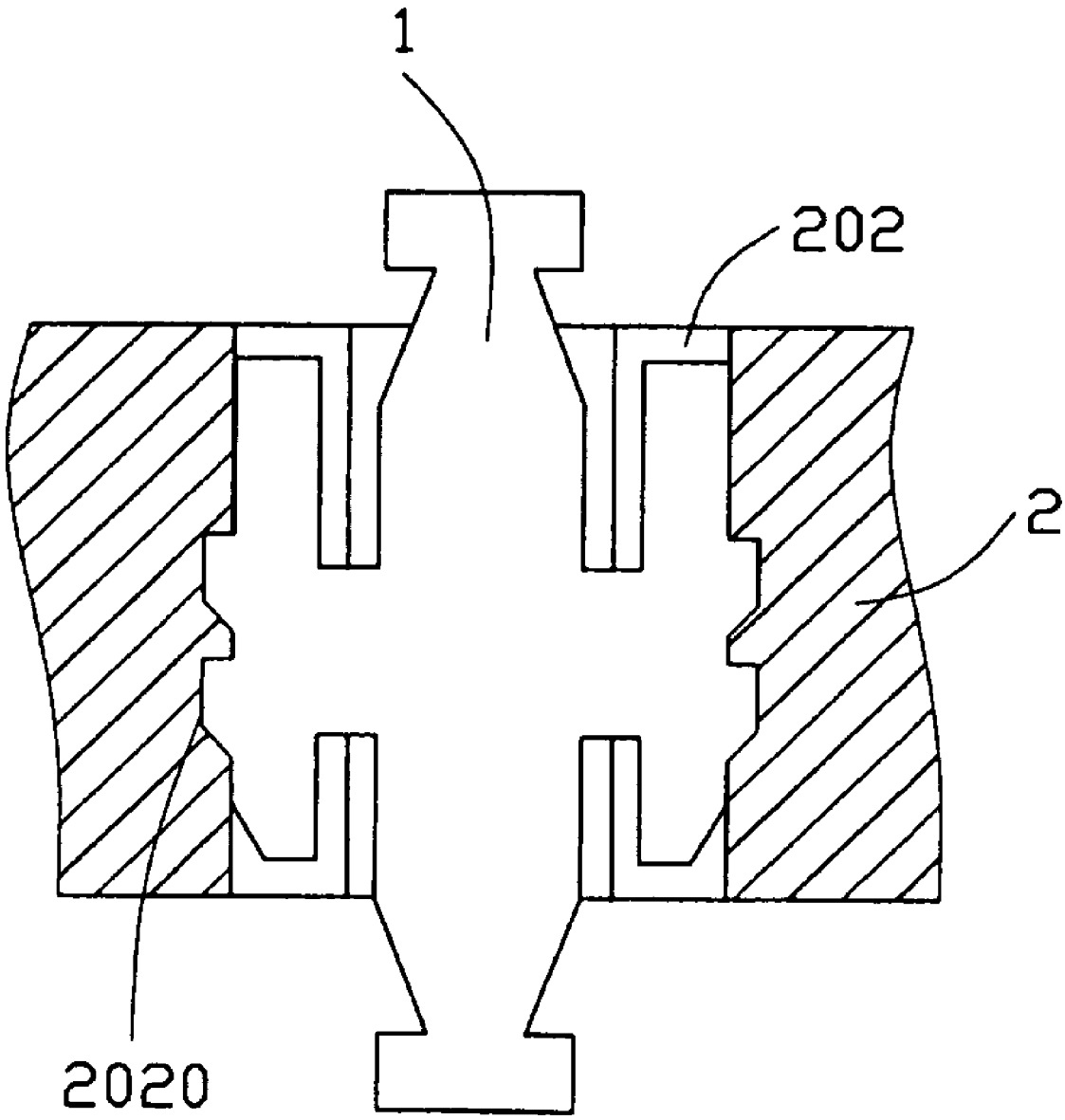
FIG. 5 is a cross-sectional view taking along a line V—V of FIG. 4.

As shown more clearly in FIG. 5, each passageway 20 extends through the housing from a top face to a bottom face thereof, and is configured with a generally T-shaped profile. The passageway 20 has a broad receiving cavity 201 and a narrow retention slot 202 in communication with one end of the receiving cavity 201. Recesses 2020 are defined on each inner sidewall of the passageway 20 at opposite lateral sides of the retention slot 202, toward into the housing 2. The recesses 2020 each interferingly engage corresponding barbs 1001 when the contact 1 is disposed in the passageway 20. Thus, the contact 1 is firmly retained in the passageway 20.

Figure 6:
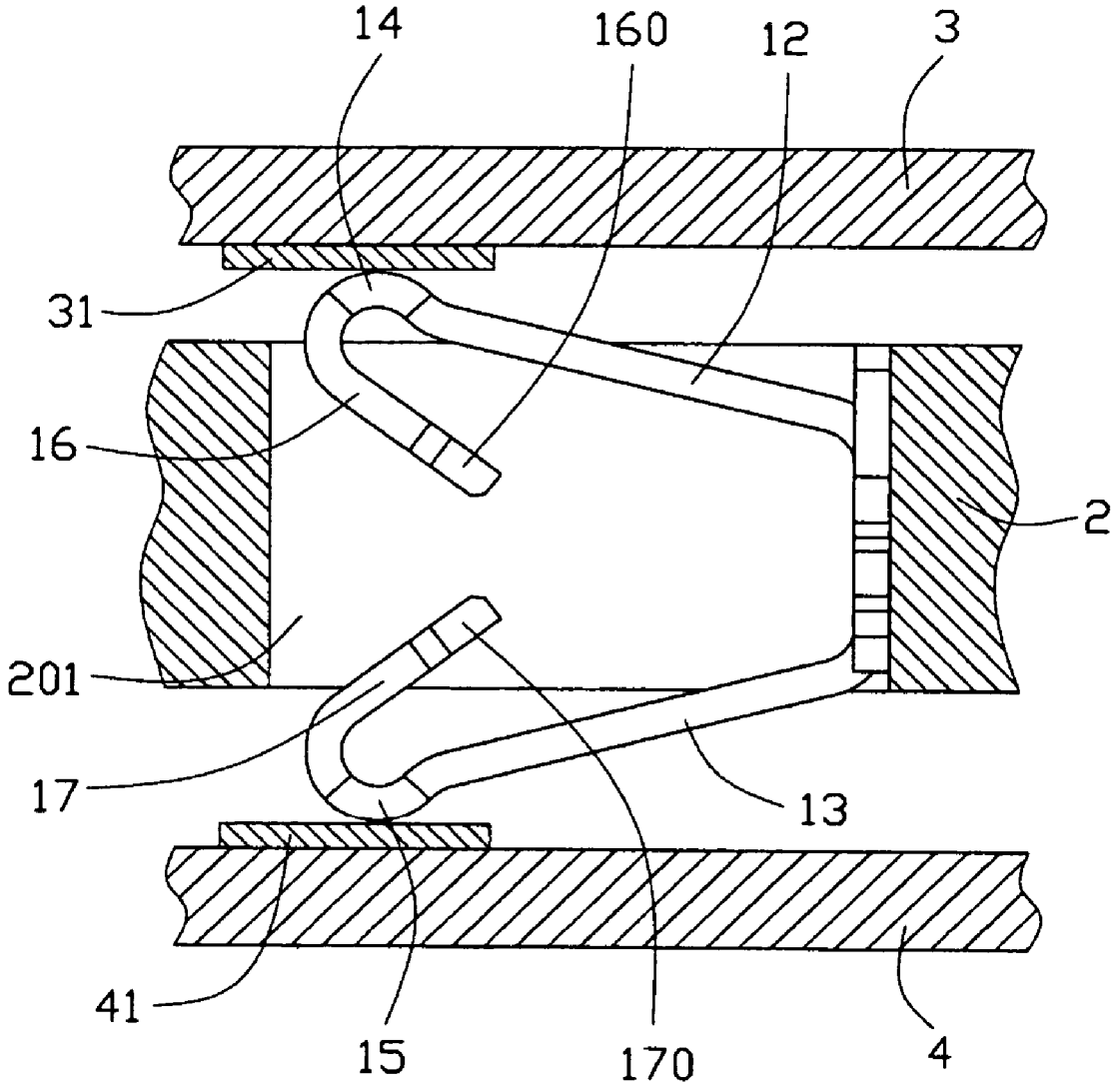
FIG. 6 is a cross-section view of the contact received in the connector between an electrical package and a PCB, showing the contact in an uncompressed condition.
Figure 7:
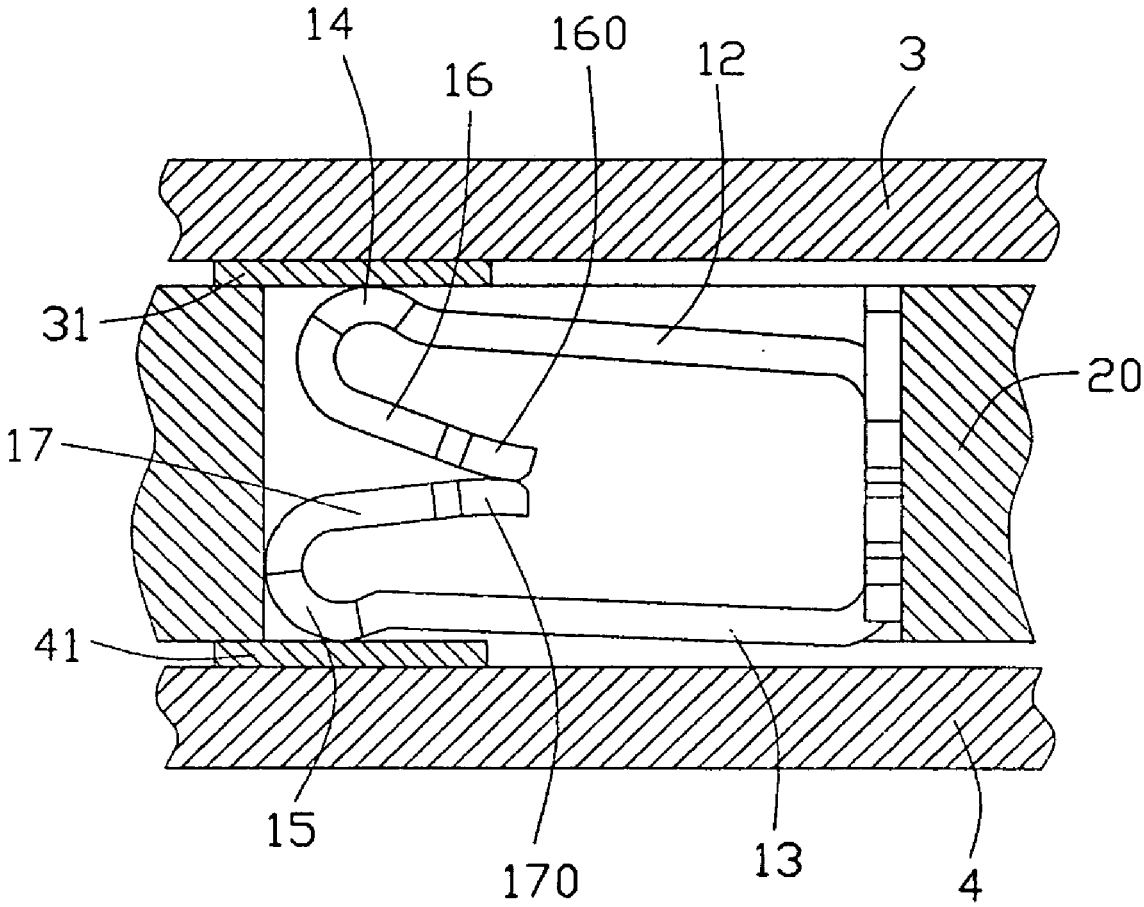
FIG. 7 is similar to FIG. 7, but showing the contact in an compressed condition)

Referring to FIGS. 6 and 7, in use, the contact 1 is retained in the housing 2 of the connector which serves to electrically connect an electrical package 3 with a PCB 4. The package 3 has electrical leads each in the form of a contact pad 31, the leads being disposed in a standardized array over a face of the package. Instead of contact pads, the IC package could have an array of solder balls, the contact of the present invention being engageable with either ball or pad type leads. The PCB 4 has an array of contact pads 41 corresponding to the array of pads 31 of the package. The first and second contact portions 14,15 of the contact 1 engage the respective pads 31,41 when the package 3 is urged against the connector. The package 3 may be urged against the connector such as by pressure plates (not shown) arranged above the package and/or below the PCB and secured together with threaded fasteners. Thereby, the connector is sandwiched between the package 3 and the PCB 4.

Particularly referring to FIG. 6, When the package 3 is not completely urged to press against the connector, the contact 1 is in uncompressed state. The contact portions 14, 15 of the contact 1 protrudes out from the respective top and bottom faces of the housing 2, and the spring arms 12,13 and the cantilevers 16,17 all partly be received in the receiving cavity 201 of the housing 2. The first mating section 160 of the first cantilever 16 is apart from the second mating section 170 of the second cantilever 17.

When the package 3 is completely urged and presses against the connector, as best seen in FIG. 7, the contact 1 is pressed toward the passageway 20. The spring arms 12, 13 both resiliently deform to be a position where they are relatively closer together, completely being received within the receiving cavity 201. The cantilevers 16, 17 close toward each other in a direction that is substantially parallel to a compressed direction of the contact, and the first mating section 160 of the first cantilever 16 engages the second mating section 170 of the second cantilever 17. Thus, a short and direct, and a parallel long electrical path are produced between the first and second contact portion 14, 15. The long path extends both of the spring arms 12, 13 and the retention portion 10, while the short path just passes through the cantilevers 16, 17. The short electrical path has relatively lower self-inductance and resistance compared with the long path. Current flow will favor the short path with lower inductance, of course. Thus, a reduced self-inductance effect is obtained in the contact. In addition, the cantilevers 16, 17 resiliently deform as the contact 1 is compressed, and this thereby enhancing the elastic deformation of the contact. This can secure the contact 1 have good resilient characteristic, even if the spring arms 12, 13 having weak elasticity because of being compressed many times. As a result, reliable electrical connecting between the package and the PCB is secured.

While preferred embodiments in accordance with the present invention have been shown and described, equivalent modifications and changes known to persons skilled in the art according to the spirit of the present invention are considered within the scope of the present invention as defined in the appended claims.

What is claimed is:

1. An electrical contact comprising:

a retention portion;

a pair of spring arms extending from two opposite sides of the retention portion;

a pair of contact portion: formed at respective free ends of the spring arms; and first and second spaced shorting members extending from the contact portions respectively, generally toward each other; and first and second mating sections formed at respective free ends of first and second shorting members, the mating sections each having a larger sectional dimension compared with that of the corresponding free ends of the shorting members, when the contact being compressed and resiliently deforming, the shorting members closing toward each other, and the fiat mating section of the first shorting member engaging the second mating section of the second shorting member, thereby a shortened electrical path being established between the contact portions wherein the contact portion have sectional widths larger than those of the free ends of the spring arms respectively.

2. The electrical contact as claimed in claim 1, wherein the retention portion has a pair of vertical locating sections extending coplanarly from two lateral sides thereof adjacent the opposite sides the spring arms extending therefrom.

3. The electrical contact as claimed in claim 2, wherein the locating sections each have barbs protruding outwardly from a lateral side edge thereof for interfering fixing the contact in a connector.

4. The electrical contact as claimed in claim 3, the spring arms angularly diverge as they extend from the retention portion.

5. An electrical contact used in a connector for electrically interconnecting two electrical interfaces, the electrical contact comprising:

a pair of opposite spring aims separated from each other;

a vertical retention portion interconnecting the spring arms;

a pair of opposite contact portions protruding outwardly from respective free ends of the spring arms for engaging the electrical interfaces;

first and second resilient shorting members extending from the contact portions respectively, generally toward each other; the shoring members being spaced apart at some dimension when the contact being in an uncompressed condition, and first and second mating sections formed oppositely at respective free ends of the first and second shorting members, sectional dimensions of the mating sections being larger than those of the free ends of the shorting members respectively, when the contact being compressed to be in a compressed condition, the shorting members resiliently deforming and closing toward each other in a direction that is substantially parallel to a compressed direction of the contact, the first mating section of the first cantilever urging and engaging the second mating section of the second cantilever so as to form a shortened electrical path between the contact portions.

6. The electrical contact as claimed in claim 5, wherein the contact portions have sectional widths larger than those of the free ends of the spring arms respectively, for providing relatively large contact areas with the electrical interfaces.

7. The electrical contact as claimed in claim 6, wherein the retention portion has a pair of vertical lateral locating sections divided by the first and second spring arms, the locating sections each have barbs protruding outwardly from a lateral side edge thereof for interfering fixing the contact in the connector.

8. The electrical contact as claimed in claim 7, the spring arms angularly diverge as they extend from the retention portion.

9. An electrical connector assembly comprising:

an insulative housing defining opposite upper and lower faces with a plurality of through passageways respectively extending therethrough;

a plurality of contacts disposed in the corresponding passageways, respectively, each of said contacts including a vertical retention section essentially abutting against an internal wall in the corresponding passageway, an upper spring arm extending from an upper portion of the retention section and a lower spring arm extending from a lower portion of the retention section, an upper cantilever arm inwardly extending from a distal end of the upper spring arm toward the housing, a lower cantilever arm inwardly extending from a distal end of the lower spring arm toward the housing, an upper contact area formed around an joint of the upper spring arm and the upper cantilever arm, a lower contact area formed around an joint of the lower spring arm and the lower cantilever arm, an upper mating section formed at a distal end of the upper cantilever arm, a lower mating section formed at a distal end of the lower cantilever arm; and the upper contact area extending out of the upper face, the lower contact area extending out of the lower face, said upper contact area and said lower contact area pressed by corresponding electronic components, respectively, to have the corresponding upper spring arm and lower spring arm deflected toward each other;

wherein the respective upper and lower mating section extend along a first inclined direction, and are widened in a second inclined direction substantially perpendicular to said first inclined direction as compared with the corresponding free ends of the cantilever arms.

10. The electrical connector assembly as claimed in claim 9 wherein said upper and lower contact areas are widened essentially in a transverse direction for engagement consideration.

11. The electrical connector assembly as claimed in claim 9 wherein said upper cantilever arm also backwardly extends from the distal end of the upper spring arm, and said lower cantilever arm also backwardly extends from the distal end of the lower spring arm, so that the joint of the upper spring arm and the upper cantilever arm and the joint of the lower spring arm and the lower cantilever arm are essentially farther away from the retention section than any other portions of the contact.

12. The electrical connector assembly as claimed in claim 9 wherein deflection of said upper spring arm and said lower spring arm continues until the upper mating section and the lower mating section are mated with each other, and said electronic components are supported by means other than said contact.

13. The electrical connector assembly as claimed in claim 9 wherein the upper mating section and lower mating section are essentially not parallel to each other while having edges parallel to each other for normally confronting each other in a vertical direction.

* * * * *